US011475850B2

(12) United States Patent
Cho et al.

(10) Patent No.: US 11,475,850 B2
(45) Date of Patent: Oct. 18, 2022

(54) DISPLAY APPARATUS, METHOD OF OPERATING A DISPLAY APPARATUS AND NON-TRANSITORY COMPUTER-READABLE MEDIUM

(71) Applicant: SAMSUNG DISPLAY CO., LTD., Yongin-si (KR)

(72) Inventors: Daeyoun Cho, Yongin-si (KR); Jongwoo Park, Seongnam-si (KR); Jiho Moon, Hwaseong-si (KR); Youngtae Choi, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/393,773

(22) Filed: Aug. 4, 2021

(65) Prior Publication Data

US 2022/0068222 A1 Mar. 3, 2022

(30) Foreign Application Priority Data

Aug. 25, 2020 (KR) ..... 10-2020-0107353

(51) Int. Cl.
*G09G 3/3291* (2016.01)

(52) U.S. Cl.
CPC ... *G09G 3/3291* (2013.01); *G09G 2320/0276* (2013.01); *G09G 2320/0285* (2013.01); *G09G 2320/043* (2013.01); *G09G 2360/16* (2013.01)

(58) Field of Classification Search
CPC ..... G09G 3/3291; G09G 2320/0276; G09G 2320/0285; G09G 2320/043; G09G 2360/16
See application file for complete search history.

(56) References Cited

U.S. PATENT DOCUMENTS

2016/0284272 A1* 9/2016 Her ..... G09G 3/3233
2017/0206819 A1* 7/2017 Pyo ..... G09G 3/3225
2018/0012530 A1* 1/2018 Lee ..... G09G 3/007
2020/0312253 A1* 10/2020 Kim ..... G09G 3/035

FOREIGN PATENT DOCUMENTS

KR 10-2006-0104849 10/2006
KR 10-2017-0136091 12/2017
KR 10-2019-0023865 3/2019
KR 10-2019-0064998 6/2019

* cited by examiner

*Primary Examiner* — Kenneth B Lee, Jr.
(74) *Attorney, Agent, or Firm* — F. Chau & Associates, LLC

(57) ABSTRACT

A display apparatus includes a display panel, a first emission driver, a second emission driver, and an emission driver controller. The first and second emission drivers are on different sides of the display panel, and each applies an emission signal to the display panel. The emission driver controller selectively drives the first emission driver and the second emission driver based on deterioration stress of the first and second emission drivers.

21 Claims, 12 Drawing Sheets

FIG. 4

| BTI/HCI | S:strong | W:weak |
|---|---|---|

| EFLM | HIGH | LOW |
|---|---|---|
| T1 | S | W |
| T2 | S | W |
| T3 | W | S |
| T4 | W | S |
| T5 | W | S |
| T6 | W | S |
| T7 | S | W |
| T8 | S | W |
| T9 | S | W |
| T10 | W | S |
| T11 | S | W |
| T12 | S | W |

FIG. 7

| BAND | Brightness control(DBV) | AOR | Time(h) | 1st Emission Driver(h) | 2nd Emission Driver(h) |
|---|---|---|---|---|---|
| 1st | 1200nit | 0.1% | 10 | 5 | 5 |
| 2nd | 600nit | 0.1% | 10 | 5 | 5 |
| 3rd | 300nit | 0.1% | 40 | 20 | 20 |
| 4th | 100nit | 0.1% | 100 | 50 | 50 |
| 5th | 60nit | 40% | 300 | 150 | 150 |
| 6th | 30nit | 70% | 500 | 250 | 250 |
| 7th | 15nit | 85% | 100 | 50 | 50 |
| 8th | 10nit | 90% | 1000 | 500 | 500 |
| 9th | 7nit | 93% | 100 | 50 | 50 |
| 10th | 4nit | 96% | 600 | 300 | 300 |

DISPLAY APPARATUS, METHOD OF OPERATING A DISPLAY APPARATUS AND NON-TRANSITORY COMPUTER-READABLE MEDIUM

CROSS-REFERENCE TO RELATED APPLICATIONS

This application claims priority under 35 U.S.C. § 119 to Korean Patent Application No. 10-2020-0107353, filed on Aug. 25, 2020 in the Korean Intellectual Property Office KIPO, the contents of which are herein incorporated by reference in its entirety.

BACKGROUND

1. Field

One or more embodiments described herein relate to a display apparatus, a method of operating a display apparatus and a non-transitory computer-readable medium.

2. Description of the Related Art

A display apparatus may include one or more emission drivers for controlling a display panel. Over time, performance of the emission driver(s) may deteriorate (e.g., experience deterioration stress) severely enough to cause a flicker or flash phenomenon. This, in turn, may reduce the useful life of the emission driver(s) and thus of the display apparatus.

SUMMARY

One or more embodiments of the present inventive concept provide a display apparatus capable of increasing or maximizing the lifetime of an emission drive, by reducing or minimizing usage of the emission driver.

One or more embodiments of the present inventive concept provide a method of operating a display apparatus capable of increase or maximizing the lifetime of an emission driver, by reducing or minimizing usage of the emission driver.

In accordance with one or more embodiments, a display apparatus includes a display panel including a plurality of pixels, a first emission driver configured to apply an emission signal to the display panel and disposed on a first side of the display panel, a second emission driver configured to apply the emission signal to the display panel and disposed on a second side of the display panel different from the first side, and an emission driver controller configured to selectively drive the first emission driver and the second emission driver according to deterioration stress of the first emission driver and the second emission driver.

In an embodiment, the emission driver controller may include a data converter configured to receive luminance data and convert the luminance data into AOR data corresponding to the luminance data, a stress calculator configured to calculate the deterioration stress of the first emission driver and the second emission driver based on the AOR data and a driver selector configured to control operations of the first emission driver and the second emission driver according to the deterioration stress.

In an embodiment, the driver selector may control the operations of the first emission driver and the second emission driver by comparing a first deterioration stress representing the deterioration stress of the first emission driver with a second deterioration stress representing the deterioration stress of the second emission driver.

In an embodiment, the data converter may divide the luminance data into first to tenth bands and convert the luminance data into the AOR data corresponding to each of the first to tenth bands.

In an embodiment, the data converter may store a look up table in which the AOR data corresponding to each of the first to tenth bands are defined.

In an embodiment, the stress calculator may calculate the deterioration stress by accumulating the AOR data according to driving times of the first emission driver and the second emission driver.

In an embodiment, when the first deterioration stress is smaller than the second deterioration stress, the driver selector may control the first emission driver to operate and the second emission driver not to operate.

In an embodiment, when the first deterioration stress is greater than the second deterioration stress, the driver selector may control the first emission driver not to operate and the second emission driver to operate.

In an embodiment, when the first deterioration stress and the second deterioration stress are greater than a reference deterioration stress, the driver selector may control both the first emission driver and the second emission driver to operate.

In an embodiment, the emission driver controller accumulates the AOR data to store usage data and deterioration data of switching elements included in the first emission driver and the second emission driver.

In accordance with one or more embodiments, a method of operating a display apparatus includes calculating deterioration stress of a first emission driver and a second emission driver, and controlling the first emission driver and the second emission driver to selectively operate according to the deterioration stress.

In an embodiment, the calculating of the deterioration stress may comprise receiving luminance data, converting the luminance data into AOR data corresponding to the luminance data and calculating the deterioration stress of the first emission driver and the second emission driver based on the AOR data.

In an embodiment, the controlling the first emission driver and the second emission driver may comprise controlling operations of the first emission driver and the second emission driver by comparing a first deterioration stress representing the deterioration stress of the first emission driver with a second deterioration stress representing the deterioration stress of the second emission driver.

In an embodiment, the calculating of the deterioration stress may comprise dividing the luminance data into first to tenth bands and converting the luminance data into the AOR data corresponding to each of the first to tenth bands.

In an embodiment, the calculating of the deterioration stress may comprise storing a look up table in which the AOR data corresponding to each of the first to tenth bands are defined.

In an embodiment, the calculating of the deterioration stress may comprise calculating the deterioration stress by accumulating the AOR data according to driving times of the first emission driver and the second emission driver.

In an embodiment, the controlling the first emission driver and the second emission driver may comprise controlling the first emission driver to operate and the second emission driver not to operate when the first deterioration stress is smaller than the second deterioration stress.

In an embodiment, the controlling the first emission driver and the second emission driver may comprise controlling the first emission driver not to operate and the second emission driver to operate when the first deterioration stress is greater than the second deterioration stress.

In an embodiment, the controlling the first emission driver and the second emission driver may comprise controlling both the first emission driver and the second emission driver to operate when the first deterioration stress and the second deterioration stress are greater than a reference deterioration stress.

In an embodiment, the method may further comprise storing usage data and deterioration data of switching elements included in the first emission driver and the second emission driver by accumulating the AOR data.

In accordance with one or more embodiments, a non-transitory computer-readable medium configured to store instructions, which, when executed by one or more processors, causes the one or more processors to determine stress of a first emission driver of a display panel, determine stress of a second emission driver of the display panel, and control operation of at least one of the first emission driver or the second emission driver according to the stress of each of the first emission driver and the second emission driver. When the stress of the first emission driver is greater than the stress of the second emission driver, the one or more processors are configured to execute the instructions to control activation of the second emission driver to reduce a difference between the stresses of the first emission driver and the second emission driver.

BRIEF DESCRIPTION OF THE DRAWINGS

The above and other features of the present inventive concept will become more apparent by describing in detailed embodiments thereof with reference to the accompanying drawings, in which:

FIG. 4 illustrates an example of deterioration stress of switching elements.

FIG. 7 illustrates an example of a lookup table of an emission driver controller.

DETAILED DESCRIPTION OF THE INVENTIVE CONCEPT

Figure 1:
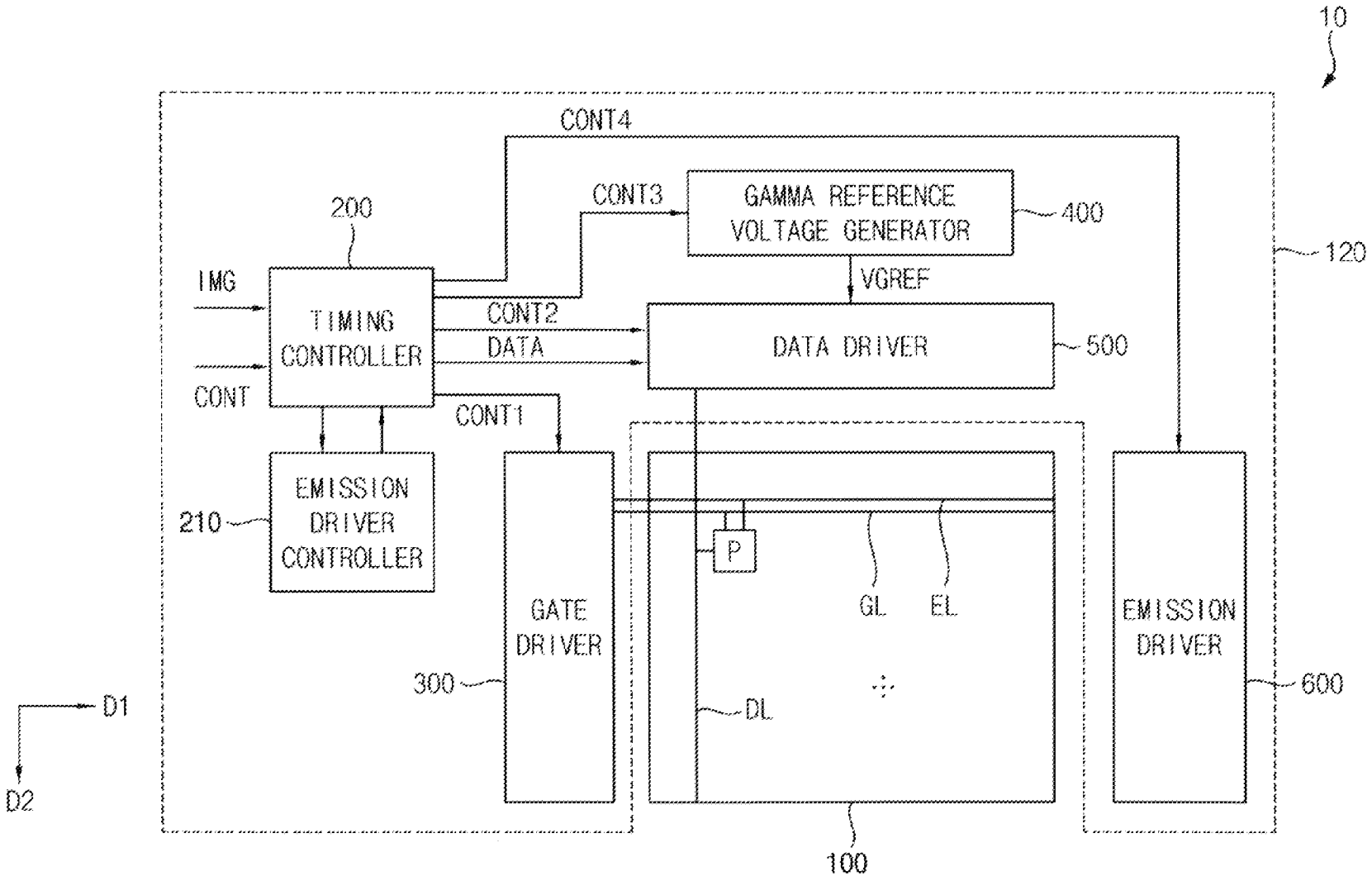
FIG. 1 illustrates an embodiment of a display apparatus.
Figure 2:
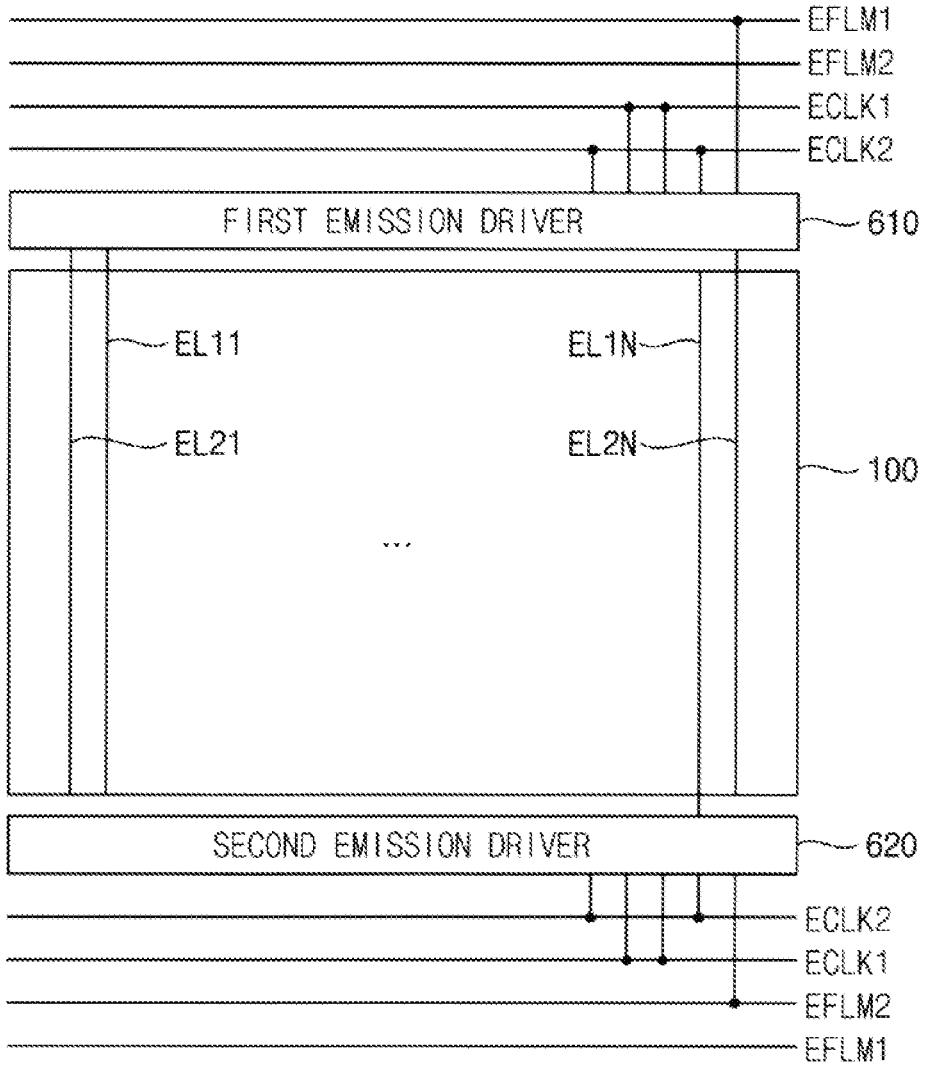
FIG. 2 illustrates an embodiment of an emission driver.

FIG. 1 is a block diagram illustrating a display apparatus 10 according to embodiments, and FIG. 2 is a block diagram illustrating a display panel 100, an emission driver 600 and signal lines which may be included in or coupled to the display apparatus 10 of FIG. 1.

Referring to FIG. 1, the display apparatus 10 may include a display panel 100 and a display panel driver 120. The display panel driver 120 may include a timing controller 200, a gate driver 300, a gamma reference voltage generator 400, a data driver 500, and an emission driver 600. In addition, the display panel driver 120 may include or be coupled to an emission driver controller 210.

The display panel 100 may include a display region for displaying an image and a peripheral region adjacent to the display region. The display panel 100 may include a plurality of gate lines GL, a plurality of data lines DL, a plurality of emission lines EL, and a plurality of pixels electrically connected to each of the gate lines GL, the data lines DL, and the emission lines EL. The gate lines GL may extend in a first direction D1, and the data lines DL may extend in a second direction D2 crossing the first direction D1. The emission lines EL may also extend in the first direction D1.

The timing controller 200 may receive input image data IMG and an input control signal CONT from an external apparatus. For example, the input image data IMG may include red image data, green image data, and blue image data. In one embodiment, the input image data IMG may include white image data. In one embodiment, the input image data IMG may include magenta image data, yellow image data, and cyan image data, or image data corresponding to another combination of colors. The input control signal CONT may include a master clock signal and a data enable signal. The input control signal CONT may further include a vertical synchronization signal and a horizontal synchronization signal.

The timing controller 200 may generate a first control signal CONT1, a second control signal CONT2, a third control signal CONT3, a fourth control signal CONT4 and a data signal DATA based on the input image data IMG and the input control signal CONT.

The timing controller 200 may generate the first control signal CONT1 for controlling the operation of the gate driver 300 based on the input control signal CONT and may output the generated first control signal CONT1 to the gate driver 300. The first control signal CONT1 may include a vertical start signal and a gate clock signal.

The timing controller 200 may generate the second control signal CONT2 for controlling the operation of the data driver 500 based on the input control signal CONT and may output the generated second control signal CONT2 to the data driver 500. The second control signal CONT2 may include a horizontal start signal and a load signal.

The timing controller 200 may generate the data signal DATA based on the input image data IMG. The timing controller 200 may output the data signal DATA to the data driver 500.

The timing controller 200 may generate the third control signal CONT3 based on the input control signal CONT for controlling the operation of the gamma reference voltage generator 400. The timing controller 200 may output the third control signal CONT3 to the gamma reference voltage generator 400.

The timing controller 200 may generate the fourth control signal CONT4 based on the input control signal CONT for controlling the operation of the emission driver 600. The timing controller 200 may output the fourth control signal CONT4 to the emission driver 600.

The gate driver 300 may generate gate signals for driving the gate lines GWL, GIL, and GBL in response to the first control signal CONT1 from the timing controller 200. The gate driver 300 may output the gate signals to the gate lines GWL, GIL, and GBL. For example, the gate driver 300 may be integrated on the display panel 100, e.g., the gate driver 300 may be mounted on the display panel 100.

The gamma reference voltage generator 400 may generate a gamma reference voltage VGREF in response to the third control signal CONT3 from the timing controller 200. The gamma reference voltage generator 400 may provide the gamma reference voltage VGREF to the data driver 500. The gamma reference voltage VGREF may have a value corresponding to the data signal DATA. The gamma reference voltage generator 400 may be disposed in, or may be coupled to, the timing controller 200 or in, or coupled to, the data driver 500.

The data driver 500 may receive the second control signal CONT2 and the data signal DATA from the timing controller 200 and may receive the gamma reference voltage VGREF from the gamma reference voltage generator 400. The data driver 500 may convert the data signal DATA to a data voltage having an analog type using the gamma reference voltage VGREF. The data driver 500 may output the data voltage to the data line DL.

The emission driver 600 may generate emission signals for driving the emission lines EL in response to the fourth control signal CONT4 from the timing controller 200. The emission driver 600 may output the emission signals to the emission lines EL.

In FIG. 1, the gate driver 300 is disposed on a first side of the display panel 100 and the emission driver 600 is disposed on a second side opposite to the first side of the display panel 100. In one embodiment, the gate driver 300 and the emission driver 600 may be disposed on the same side with respect to the display panel 100. In one embodiment, the gate driver 300 and the emission driver 600 may be integrally formed.

Referring to FIG. 2, according to an embodiment, the emission driver 600 may include a first emission driver 610 and a second emission driver 620. For example, the first emission driver 610 may be on a first side of the display panel 100, and the second emission driver 620 may be on a second side opposite to the first side of the display panel 100. The first emission driver 610 may generate emission signals for driving emission lines EL11 to EL1N in response to the fourth control signal CONT4 from the timing controller 200. The first emission driver 610 may output the emission signals to the emission lines EL11 to EL1N in a predetermined manner. For example, the first emission driver 610 may sequentially output emission signals to the emission lines EL11 to EL1N.

The second emission driver 620 may generate emission signals for driving emission lines EL21 to EL2N in response to the fourth control signal CONT4 from the timing controller 200. The second emission driver 620 may output the generated emission signals to the emission lines EL21 to EL2N in a predetermined manner. For example, the second emission driver 620 may sequentially output emission signals to emission lines EL21 to EL2N. In one embodiment, the first emission driver 610 and the second emission driver 620 may operate alternately. In another embodiment, the first emission driver 610 and the second emission driver 620 may operate simultaneously.

The display panel driver 120 may include an emission driver controller 210, which controls the first emission driver 610 and the second emission driver 620 to operate selectively according to deterioration stress of the first emission driver 610 and the second emission driver 620. For example, the emission driver controller 210 may receive luminance data DBV and may convert the luminance data DBV to AOR data corresponding to the luminance data DBV, where DBV stands for digital brightness value, AOR stands for AMOLED off ratio, and AMOLED stands for active matrix organic light emitting diode. The emission driver controller 210 may calculate the deterioration stress of the first emission driver 610 and the second emission driver 620 based on the AOR data. The emission driver controller 210 may control operations of the first emission driver 610 and the second emission driver 620 according to deterioration stress.

In FIG. 1, the emission driver controller 210 is an independent configuration. In one embodiment, the emission driver controller 210 may be disposed outside the timing controller 200 to provide an emission driver control signal to the timing controller 200. In one embodiment, the emission driver controller 210 may be disposed inside the timing controller 200 and may be a component of the timing controller 200.

Figure 3:
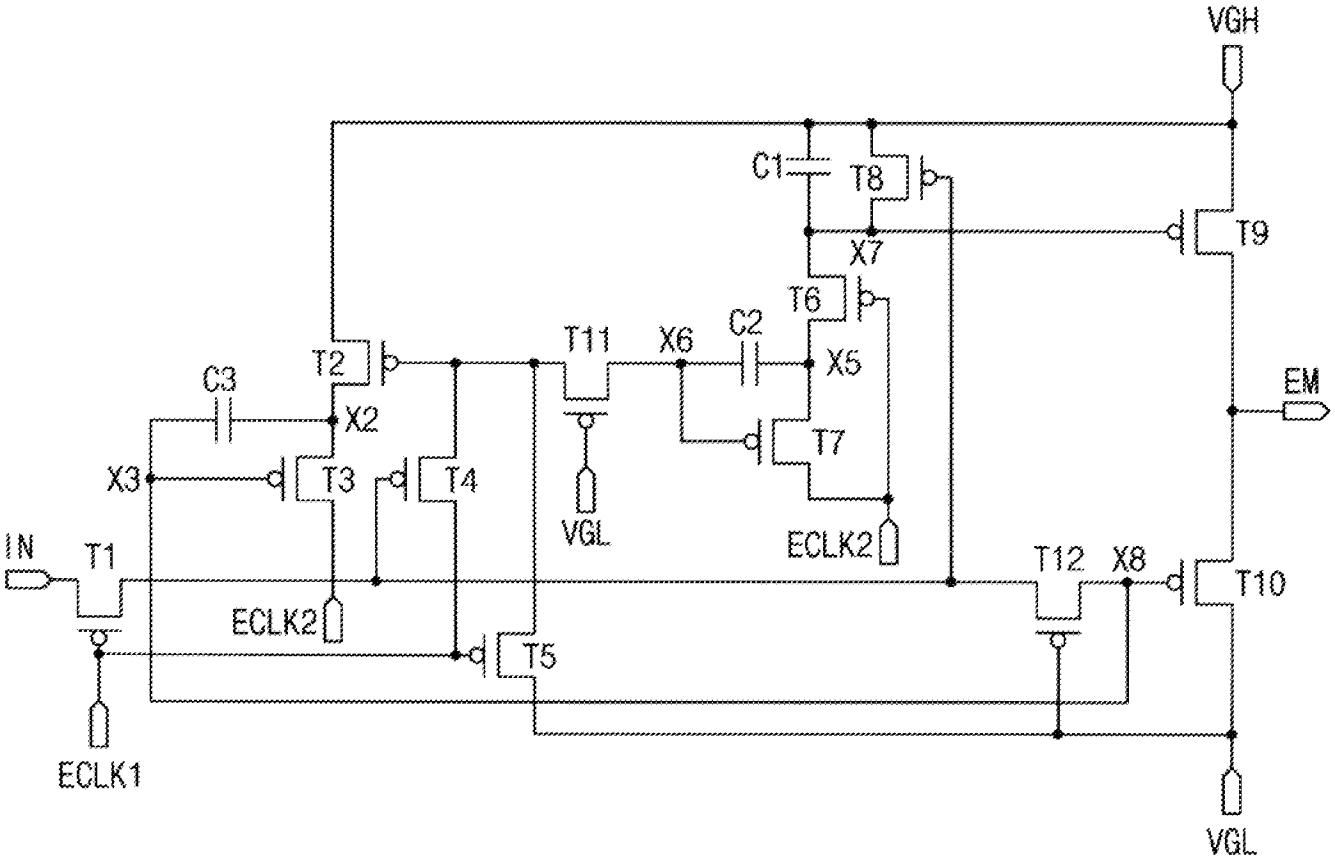
FIG. 3 illustrates an embodiment of an emission driver.

FIG. 3 is a circuit diagram illustrating an embodiment of emission driver 600 in the display apparatus 10 of FIG. 1. FIG. 4 is a table illustrating an example of deterioration stress of switching elements according to an emission start signal EFLM.

Referring to FIGS. 1 to 3, each of the first emission driver 610 and the second emission driver 620 may include a ninth switching element T9 connected between a first gate power voltage terminal (to which a first gate power voltage VGH is applied) and an emission signal output terminal (from which the emission signal EM is output). Each of the first emission driver 610 and the second emission driver 620 may also include a tenth switching element T10 connected between a second gate power voltage terminal (to which a second gate power voltage VGL is applied) and the emission signal output terminal. The first emission driver 610 and the second emission driver 620 may include a pull-down circuit for pulling down the emission signal EM to the second gate power voltage VGL. The pull-down circuit may include a first switching element T1, a second switching element T2, a third switching element T3, the tenth switching element T10, and a twelfth switching element T12.

Each of the first emission driver 610 and the second emission driver 620 may include a pull-up circuit for pulling up the emission signal EM to the first gate power voltage VGH. The pull-up circuit may include a fourth switching element T4, a fifth switching element T5, a sixth switching element T6, a seventh switching element T7, an eighth switching element T8, a ninth switching element T9, and an eleventh switching element T11.

Each of the first emission driver 610 and the second emission driver 620 may include a first capacitor C1, a second capacitor C2, and a third capacitor C3. The first capacitor C1 may include a first electrode connected to a first gate power voltage terminal and a second electrode connected to a seventh node X7. The second capacitor C2 may include a first electrode connected to the fifth node X5 and a second electrode connected to the sixth node X6. The third capacitor C3 may include a first electrode connected to the second node X2 and a second electrode connected to the third node X3. In one embodiment, the first capacitor C1 may be a stabilizing capacitor that stabilizes the voltage of the seventh node X7. The second capacitor C2 may be a boosting capacitor that sufficiently reduces the voltage of the seventh node X7 to a low level. The third capacitor C3 may be a boosting capacitor that sufficiently reduces the voltage of the eighth node X8 to a low level.

The first to twelfth switching elements T1 to T12 may receive different deterioration stresses depending on a count of activation duration of the emission start signal EFLM. For example, even with the same AOR data, each of the first to twelfth switching elements T1 to T12 may have different degrees of deterioration stress.

Referring to FIG. 4, the first switching element T1 may be vulnerable to deterioration due to a certain degree of the activation duration of the emission start signal EFLM. The second switching element T2 may be vulnerable to a certain degree of deterioration due to the activation duration of the emission start signal EFLM. The third switching element T3 may be vulnerable to a certain degree of deterioration due to the deactivation duration of the emission start signal EFLM. The fourth switching element T4 may be vulnerable to a certain degree of deterioration due to the deactivation duration of the emission start signal EFLM. The fifth switching element T5 may be vulnerable to deterioration due to a certain degree of the deactivation duration of the emission start signal EFLM. The sixth switching element T6 may be vulnerable to a certain degree of deterioration due to the deactivation duration of the emission start signal EFLM. The seventh switching element T7 may be vulnerable to deterioration due to a certain degree of the activation duration of the emission start signal EFLM. The eighth switching element T8 may be vulnerable to deterioration due to a certain degree of the activation duration of the emission start signal EFLM. The ninth switching element T9 may be vulnerable to a certain degree of deterioration due to the activation duration of the emission start signal EFLM. The tenth switching element T10 may be vulnerable to a certain degree of deterioration due to the deactivation duration of the emission start signal EFLM. The eleventh switching element T11 may be vulnerable to a certain degree of deterioration due to the activation duration of the emission start signal EFLM. The twelfth switching element T12 may be vulnerable to deterioration due to a certain degree of the activation duration of the emission start signal EFLM.

The activation duration of the emission signal EFLM is illustrated as a low level in FIG. 4 (based on the assumption that the first to twelfth switching elements T1 to T12 are implemented as p-channel metal oxide semiconductor (PMOS) transistors). In one embodiment, the activation duration of the emission signal EFLM may be the high level when the first to twelfth switching elements T1 to T12 are implemented as n-channel metal oxide semiconductor (NMOS) transistors.

In operation, at least some, if not all, of the first to twelfth switching elements T1 to T12 may experience different degrees of deterioration stress according to AOR data. The deterioration stresses of the first to twelfth switching elements T1 to T12, according to the emission start signal, may therefore be individually calculated to accurately calculate the overall deterioration stress of the emission driver. In one embodiment, the emission driver controller 210 may calculate the first deterioration stress and the second deterioration stress by accumulating the AOR data over time, so that the emission driver controller 210 may calculate the deterioration stress of each of the first to twelfth switching elements T1 to T12.

Figure 5:
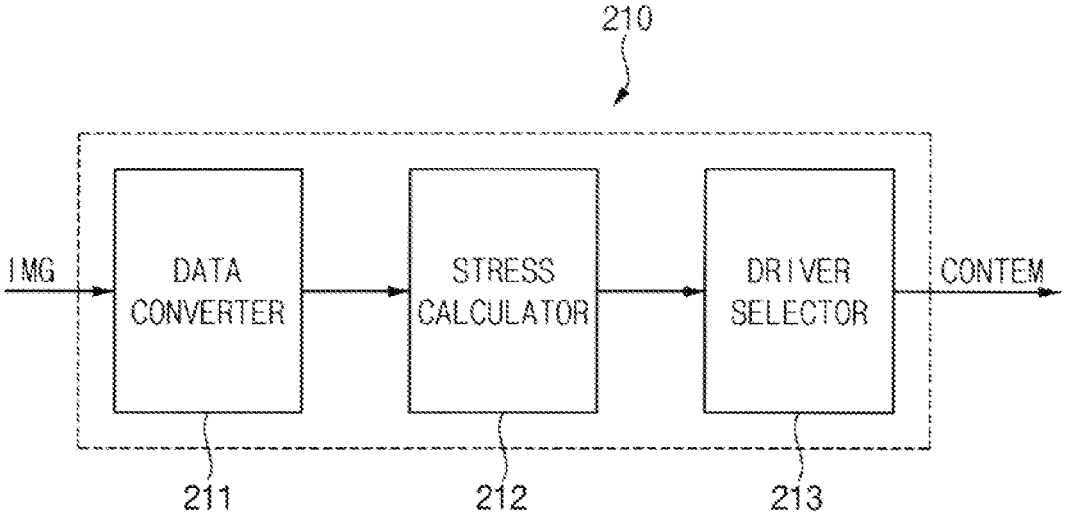
FIG. 5 illustrates an embodiment of an emission driver controller.

FIG. 5 is a block diagram illustrating an embodiment of an emission driver controller 210, which, for example, may be included in or coupled to the display apparatus of FIG. 1.

Referring to FIG. 5, the emission driver controller 210 may include a data converter 211, a stress calculator 212, and a driver selector 213. The data converter converts the luminance data DBV to AOR data corresponding to the luminance data DBV. The stress calculator 212 calculates the deterioration stress of the first emission driver 610 and the second emission driver 620 based on the AOR data. The driver selector 213 controls operation of the first emission driver 610 and second emission driver 620 according to the deterioration stress.

The data converter 211 may divide the luminance data DBV into first to tenth bands and may convert the luminance data DBV to the AOR data corresponding to the first to tenth bands. The data converter 211 may store a lookup table, in which the AOR data corresponding to each of the first to tenth bands is designated. For example, the lookup table in which the AOR data stored in the data converter 211 is designated may be data input by a user.

The stress calculator 212 may calculate the deterioration stress by accumulating the AOR data according to driving times of the first emission driver 610 and the second emission driver 620. For example, the stress calculator 212 may accumulate the AOR data according to the driving times of the first emission driver 610 and the second emission driver 620, so that the stress calculator 212 may calculate deterioration stress of each of the first emission driver 610 and the second emission driver 620. In one embodiment, the stress calculator 212 may store the driving times of the first emission driver 610 and the second emission driver 620. The stress calculator 212 may calculate the first deterioration stress by accumulating the AOR data converted by the data converter 211 according to the driving time of the first emission driver 610. In addition, the stress calculator 212 may calculate the second deterioration stress by accumulating the AOR data converted by the data converter 211 according to the driving time of the second emission driver 620.

The driver selector 213 may compare the first deterioration stress (indicating deterioration stress of the first emission driver 610) with a second deterioration stress (indicating deterioration stress of the second emission driver 620) and then control operations of one or more of the first emission driver 610 or the second emission driver 620. For example, when the first deterioration stress is less than the second deterioration stress, the driver selector 213 may control the first emission driver 610 to operate and the second emission driver 620 not to operate. When the first deterioration stress is greater than the second deterioration stress, the driver selector 213 may control the first emission driver 610 not to operate and the second emission driver 620 to operate.

The display apparatus including the emission driver controller 210 may therefore increase or maximize the lifetimes of the first emission driver 610 and the second emission driver 620 by dispersing the deterioration stress of the first emission driver 610 and the second emission driver 620. Embodiments corresponding to operations of the data converter 211, the stress calculator 212, and the driver selector 213 in emission driver controller 210 are explained with reference to FIG. 6.

The emission driver controller 210 may accumulate the AOR data and may store usage data and the deterioration data of switching elements in the first emission driver 610 and the second emission driver 620. For example, using a log of the usage data and a log of the deterioration data of the switching elements, the lifetimes of the first emission driver 610 and the second emission driver 620 may be modeled for observation by a user. In addition, using the log of the usage data and the log of the deterioration data of the switching elements, the user may easily determine the cause of malfunction or abnormal operation of one or both of the first emission driver 610 and the second emission driver 620.

Figure 6:
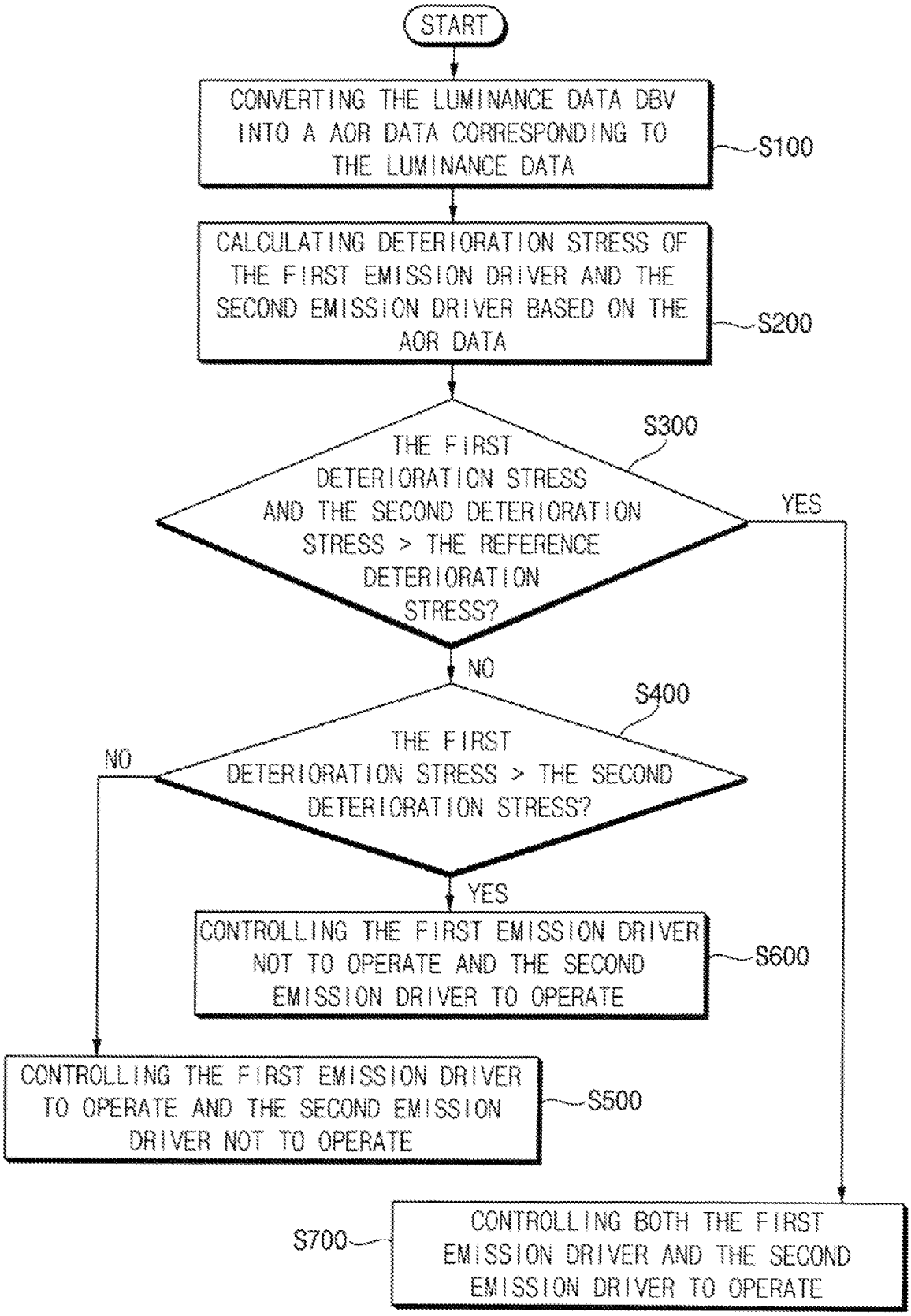
FIG. 6 illustrates an embodiment of a method of operating an emission driver controller.

FIG. 6 is a flow chart illustrating an embodiment of a method of operating the emission driver controller 210 of FIG. 5, and FIG. 7 illustrates an example of a lookup table which may be used by the emission driver controller 210 of FIG. 5 in accordance with the method.

Referring to FIGS. 6 and 7, the method includes, at S100, the data converter 211 converting luminance data DBV to AOR data, that corresponds to the luminance data DBV.

At S5200, the stress calculator 212 may calculate deterioration stress of the first emission driver 610 and the second emission driver 620 based on the AOR data.

At S300, the driver selector 213 may determine whether the first deterioration stress and the second deterioration stress are greater than a reference deterioration stress.

At S400, when the first deterioration stress and the second deterioration stress are less than the reference deterioration stress, driver selector 213 may compare the first deterioration stress with the second deterioration stress.

At S500, when the first deterioration stress is less than the second deterioration stress, driver selector 213 may control the first emission driver 610 to operate and the second emission driver 620 not to operate.

At S600, when the first deterioration stress is greater than the second deterioration stress, driver selector 213 may control the first emission driver 610 not to operate and the second emission driver 620 to operate.

At S700, when the first deterioration stress and the second deterioration stress are greater than the reference deterioration stress, driver selector 213 may control both the first emission driver and the second emission driver to operate.

In operation S100, as previously indicated by the data converter 211 may convert the luminance data DBV to AOR data corresponding to the luminance data DBV. For example, the data converter 211 may divide the luminance data DBV into a predetermined number of bands (e.g., first to tenth bands) and may convert the luminance data DBV to the AOR data corresponding to respective ones of the first to tenth bands, where applicable. A different predetermined number of bands may be used in another embodiment.

The data converter 211 may store, or be coupled to have access to, a lookup table in which the AOR data corresponding to the first to tenth bands is included. For example, the lookup table may include data input by a user. In an embodiment, the luminance data DBV received by the data converter 211 may be obtained by numerically converting a luminance of the input image data in units of nits. The luminance data DBV may be divided into first to tenth bands. In this case, the first to tenth bands of the luminance data DBV may be converted to the AOR data, respectively.

The AOR data may have a predetermined number of modes, e.g., 7 modes. In this case, each of the first to tenth bands of the luminance data DBV may be converted to 7 modes of the AOR data. Values of the converted 7 modes of the AOR data may, for example, be 0.1%, 40%, 70%, 85%, 90%, 93%, and 96%. These values may be different in another embodiment. The data converter 211 may transmit the AOR data converted from the luminance data DBV to the stress calculator 212.

In operation S200, the stress calculator 212 may calculate deterioration stress of the first emission driver 610 and the second emission driver 620 based on the AOR data. This may be accomplished as follows. The stress calculator 212 may accumulate the AOR data according to the driving times of the first emission driver 610 and the second emission driver 620. The stress calculator 212 may then calculate deterioration stress of each of the first emission driver 610 and the second emission driver 620. In one embodiment, the stress calculator 212 may store the driving times of the first emission driver 610 and the second emission driver 620.

The stress calculator 212 may calculate the first deterioration stress by accumulating the AOR data converted by the data converter 211 according to the driving time of the first emission driver 610. The stress calculator 212 may calculate the second deterioration stress by accumulating the AOR data converted by the data converter 211 according to the driving time of the second emission driver 620. The first deterioration stress may be proportional to the driving time of the first emission driver 610, and the second deterioration stress may be proportional to the driving time of the second emission driver 620.

The deterioration stress data may be different according to the AOR data corresponding to the first to tenth bands. For example, the deterioration stress of the first band may increase in proportion to AOR data corresponding to a first value (e.g., 0.1%) and the driving time (e.g., 10H) of the emission driver. The deterioration stress of the tenth band may increase in proportion AOR data corresponding the AOR to the seventh value (e.g., 96%) and the driving time (e.g., 600H) of the emission driver. The deterioration stress of the second to ninth bands may also be calculated in an analogous manner. Each of the first to twelfth switching elements T1 to T12 in the first emission driver 610 and the second emission driver 620 may have different AOR data vulnerable to degradation stress. The stress calculator 212 may calculate the deterioration stress of each of the first to twelfth switching elements T1 to T12 by calculating the first deterioration stress and the second deterioration stress using the AOR data.

In operation S300, the driver selector 213 may determine whether the first deterioration stress and the second deterioration stress are greater than the reference deterioration stress. The reference deterioration stress may be a predetermined (e.g., minimum or other level of) deterioration stress at which each of the first emission driver 610 and the second emission driver 620 can operate (e.g., operate stably or at a desired level of performance). For example, when the first deterioration stress is greater than the reference deterioration stress, the first emission driver 610 may not operate stably and may not stably output the emission signal EM to the emission lines EL. When the second deterioration stress is greater than the reference deterioration stress, the second emission driver 620 may not operate stably and may not stably output the emission signal EM to the emission lines EL.

In operation S400, when the first deterioration stress and the second deterioration stress are less than the reference deterioration stress, the driver selector 213 may compare the first deterioration stress with the second deterioration stress. For example, when the first deterioration stress and the second deterioration stress are less than the reference deterioration stress, the first emission driver 610 and the second emission driver 620 can operate stably. In this case, the driver selector 213 may compare the first deterioration stress (indicating deterioration stress of the first emission driver 610) with a second deterioration stress (indicating deterioration stress of the second emission driver 620), so that the driver selector 213 may control operation of the first emission driver 610 and the second emission driver 620.

In operation S500, for example, when the first deterioration stress is less than the second deterioration stress, the driver selector 213 may control the first emission driver 610 to operate and the second emission driver 620 not to operate. Accordingly, when the first deterioration stress is less than the second deterioration stress, the second emission driver 620 may not operate, so that the second deterioration stress can be reduced or minimized.

In operation S600, for example, when the first deterioration stress is greater than the second deterioration stress, the driver selector 213 may control the first emission driver 610 not to operate and the second emission driver 620 to operate. Accordingly, when the first deterioration stress is greater than the second deterioration stress, the first emission driver 610 may not operate, so that the first deterioration stress can be reduced or minimized.

As a result, the emission driver controller 210 may increase maximize the lifetimes of the first emission driver 610 and the second emission driver 620, by dispersing or regulating the first deterioration stress and the second deterioration stress.

In operation S700, when the first deterioration stress and the second deterioration stress are greater than the reference deterioration stress, the driver selector 213 may control both the first emission driver and the second emission driver to operate. For example, the driver selector 213 may stably operate the first emission driver 610 and the second emission driver 620 when the first deterioration stress and the second deterioration stress are greater than the reference deterioration stress. In this case, the driver selector 213 may control both the first emission driver 610 and the second emission driver 620 to operate, so that emission signals may be stably output to the emission lines EL. (In one or more embodiments, the emission signals may have the same or substantially the same format, and in this sense may be collectively referred to as "the emission signal," although the emission signal may be activated or applied at different times relative to different pixels or emission lines, for example, as described herein).

As described above, in accordance with one embodiment of the present inventive concept, the emission driver controller 210 may adjust the amount of use of the first emission driver 610 and the second emission driver 620. The emission driver controller 210 may reduce or minimize deterioration stress of the first to twelfth switching elements T1 to T12 in the first emission driver 610 and the second emission driver 620. As a result, the emission driver controller 210 may increase or maximize the lifetimes of the first emission driver 610 and the second emission driver 620, by distributing the first deterioration stress and the second deterioration stress, for example, in a manner that favors a less-deteriorated one of the first emission driver 610 or the second emission driver 620, and/or to achieve a balance or priority of deterioration stress between the first and second emission drivers 610 and 620. In addition when the first deterioration stress and the second deterioration stress are greater than the reference deterioration stress, the emission driver controller 210 may control both the first emission driver 610 and the second emission driver 620 to operate, so that the emission signal may be stably output to the emission lines EL.

Figure 8:
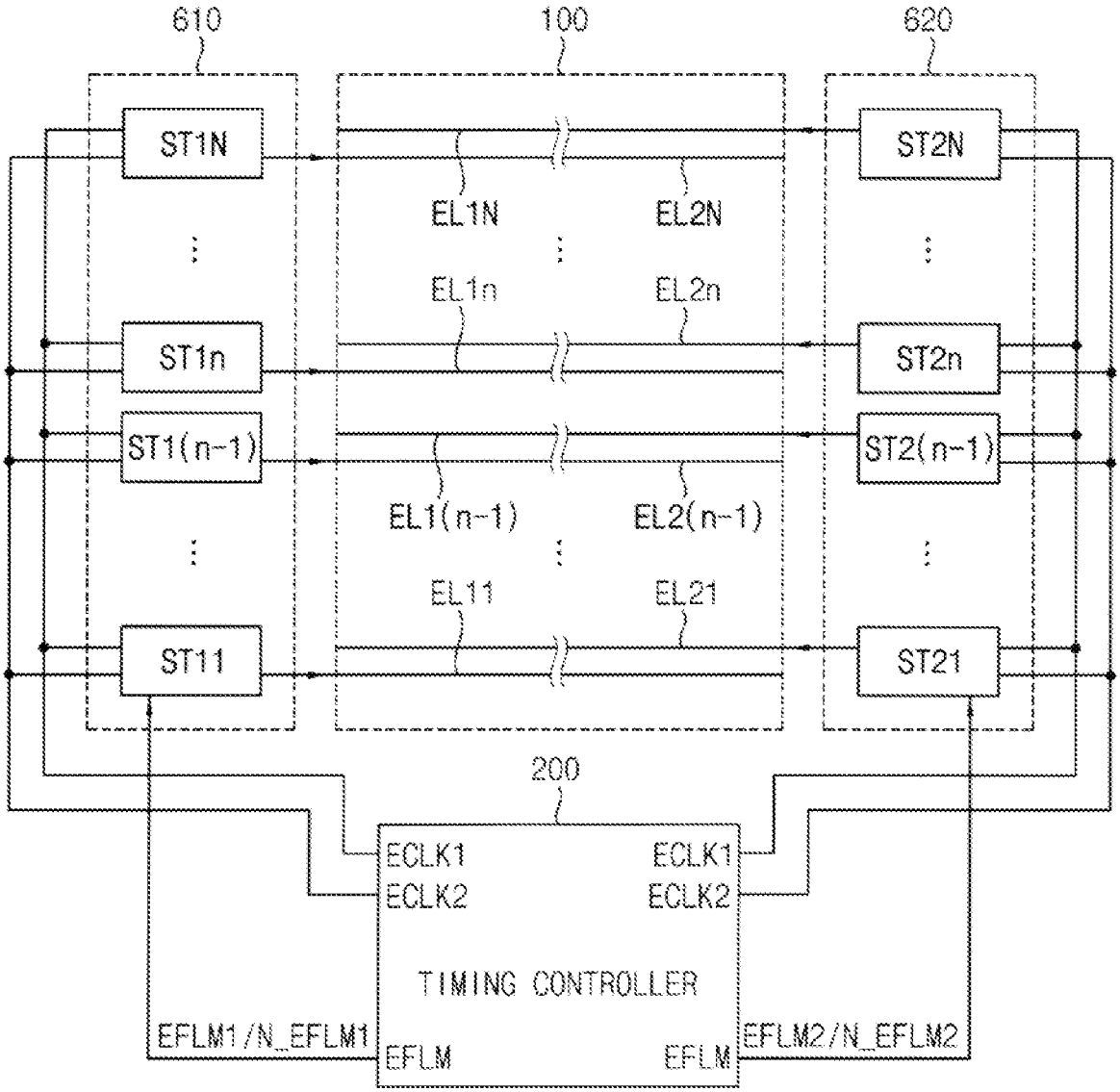
FIG. 8 illustrates an embodiment including a timing controller, a first emission driver, a second emission driver, and emission lines.

FIG. 8 is a block diagram illustrating a timing controller 200, the first emission driver 610, the second emission driver 620 and emission lines EL which are included in the display apparatus of FIG. 1.

Referring to FIGS. 5 and 8, the timing controller 200 may generate an emission start signal EFLM, a first clock signal ECLK1 and a second clock signal ECLK2 for driving the first emission driver 610 and the second emission driver 620.

The timing controller 200 may provide a first emission start signal EFLM1 as an emission start signal to the first emission driver 610. The first emission driver 610 may generate first emission signals in response to the first emission start signal EFLM1. The first emission driver 610 may include a plurality of first stages ST11 to ST1($n$−1) and ST1$n$ to ST1N connected to the plurality of first emission lines EL11 to EL1($n$−1) and EL1$n$ to EL1N of the display panel 100, respectively. The first emission lines may be connected to a plurality of pixel circuits. In one embodiment, the first stages ST11 to ST1($n$−1) and ST1($n$−1) to ST1N may output (e.g., sequentially or according to another predetermined pattern) the first emission signals synchronized with the first clock signal ECLK1 and the second clock signal ECLK2 in response to the first emission start signal EFLM1.

The timing controller 200 may provide a second emission start signal EFLM2 as an emission start signal to the second emission driver 620. The second emission driver 620 may generate second emission signals in response to the second emission start signal EFLM2. The second emission driver 620 may include a plurality of second stages ST21 to ST2($n$−1) and ST2$n$ to ST2N connected to the plurality of second emission lines EL21 to EL2($n$−1) and EL2$n$ to EL2N of the display panel 100, respectively. The second emission lines may be connected to a plurality of pixel circuits. In one embodiment, the second stages ST21 to ST2($n$−1) and ST2$n$ to ST2N may output (e.g., sequentially or according to another predetermined pattern) the second emission signals synchronized with the first clock signal ECLK1 and the second clock signal ECLK2 in response to the second emission start signal EFLM2.

For example, when the first deterioration stress is less than the second deterioration stress, the timing controller 200 may provide the first emission start signal EFLM1 for driving the first emission driver 610 to the first emission driver 610 and may provide a second emission non-start signal N_EFLM2 for not driving the second emission driver 620 to the second emission driver 620. When the first deterioration stress is greater than the second deterioration stress, the timing controller 200 may provide a first emission non-start signal N_EFLM1 for not driving the first emission driver 610 to the first emission driver 610 and may provide the second emission start signal EFLM2 for driving the second emission driver 620 to the second emission driver 620. When both the first deterioration stress and the second deterioration stress are greater than the reference deterioration stress, the timing controller 200 may provide the first emission start signal EFLM1 for driving the first emission driver 610 to the first emission driver 610 and may provide the second emission start signal EFLM2 for driving the second emission driver 620 to the second emission driver 620.

As described above, in accordance with one or more embodiments of the present inventive concept, the emission driver controller 210 may adjust the amount of use (e.g., usage times) of the first emission driver 610 and the second emission driver 620 to distribute deterioration stress between the first emission driver 610 and the second emission driver 620, either evenly or according to another distributive pattern or priority. Also, the emission driver controller 210 may reduce or minimize deterioration stress of the first to twelfth switching elements T1 to T12 in the first emission driver 610 and the second emission driver 620.

Figure 9:
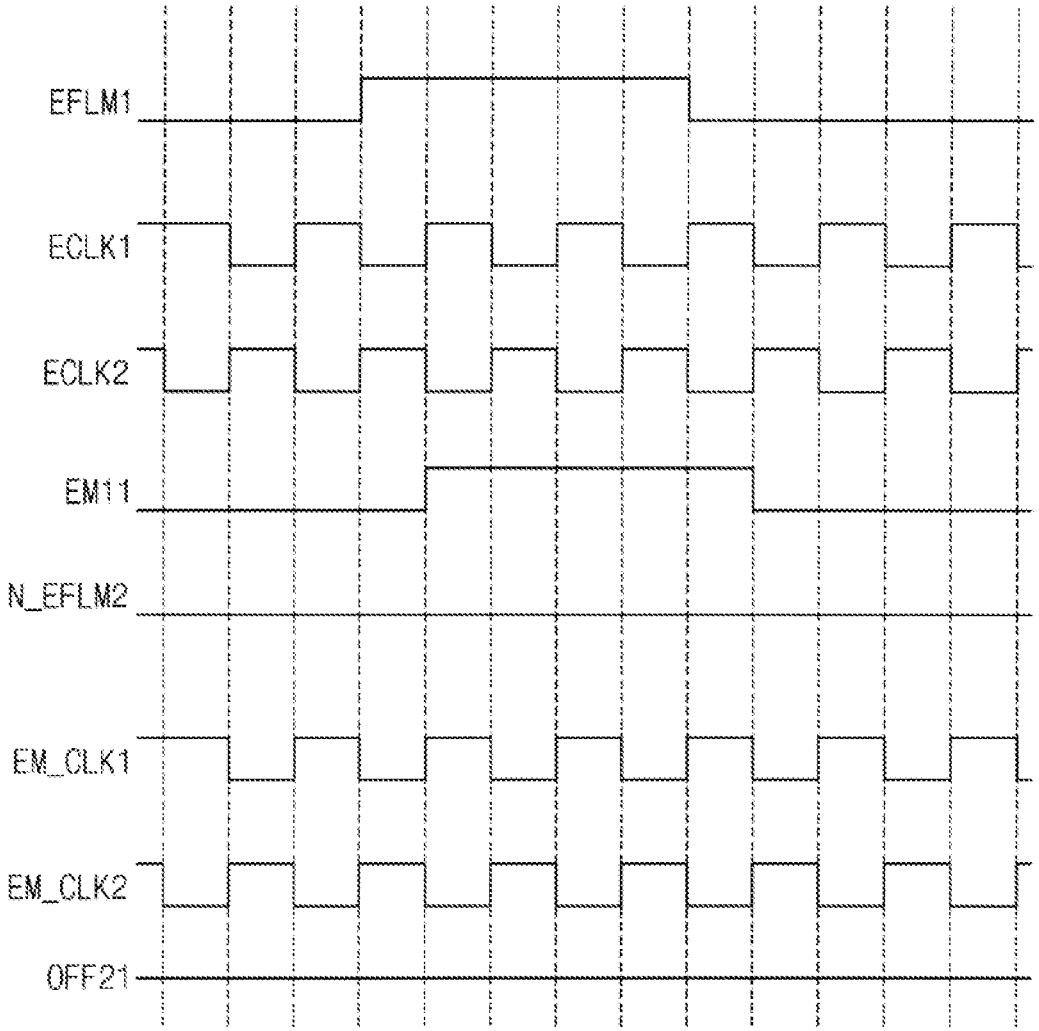
FIG. 9 illustrates an embodiment when the first emission driver operates and the second emission driver does not operate.

FIG. 9 is a timing diagram illustrating an embodiment of signals that may be applied when the first emission driver 910 operates and the second emission driver 620 does not operate.

Referring to FIGS. 8 and 9, the timing controller 200 may provide the first emission start signal EFLM1 to the first emission driver 610 and the second emission non-start signal N_EFLM2 to the second emission driver 620. For example, when the first deterioration stress is less than the second deterioration stress, the driver selector 213 may generate a signal for controlling the first emission driver 610 to operate and the second emission driver 620 not to operate. In this case, the timing controller 200 may provide the first emission start signal EFLM1 for driving the first emission driver 610 to the first emission driver 610 and may provide the second emission non-start signal N_EFLM2 for not driving the second emission driver 620 to the second emission driver 620. For example, the first stages ST11 to ST1($n$−1) and ST1($n$−1) to ST1N may output a first emission signal EM11 synchronized with the first clock signal ECLK1 and the second clock signal ECLK2 in response to the first emission start signal EFLM1. The second stages ST21 to ST2($n$−1) and ST2$n$ to ST2N may output a second emission off signal OFF21 in response to the second emission non-start signal N_EFLM2.

As described above, in accordance with one or more embodiments of the present inventive concept, the emission driver controller 210 may adjust the amount of use (e.g., usage time) of the second emission driver 620, such that the deterioration stress of the second emission driver 620 is dispersed and the deterioration stress of the first to twelfth switching elements T1 to T12 in the second emission driver 620 may be reduced or minimized. As a result, the emission driver controller 210 may increase or maximize the lifetime of the second emission driver 620.

Figure 10:
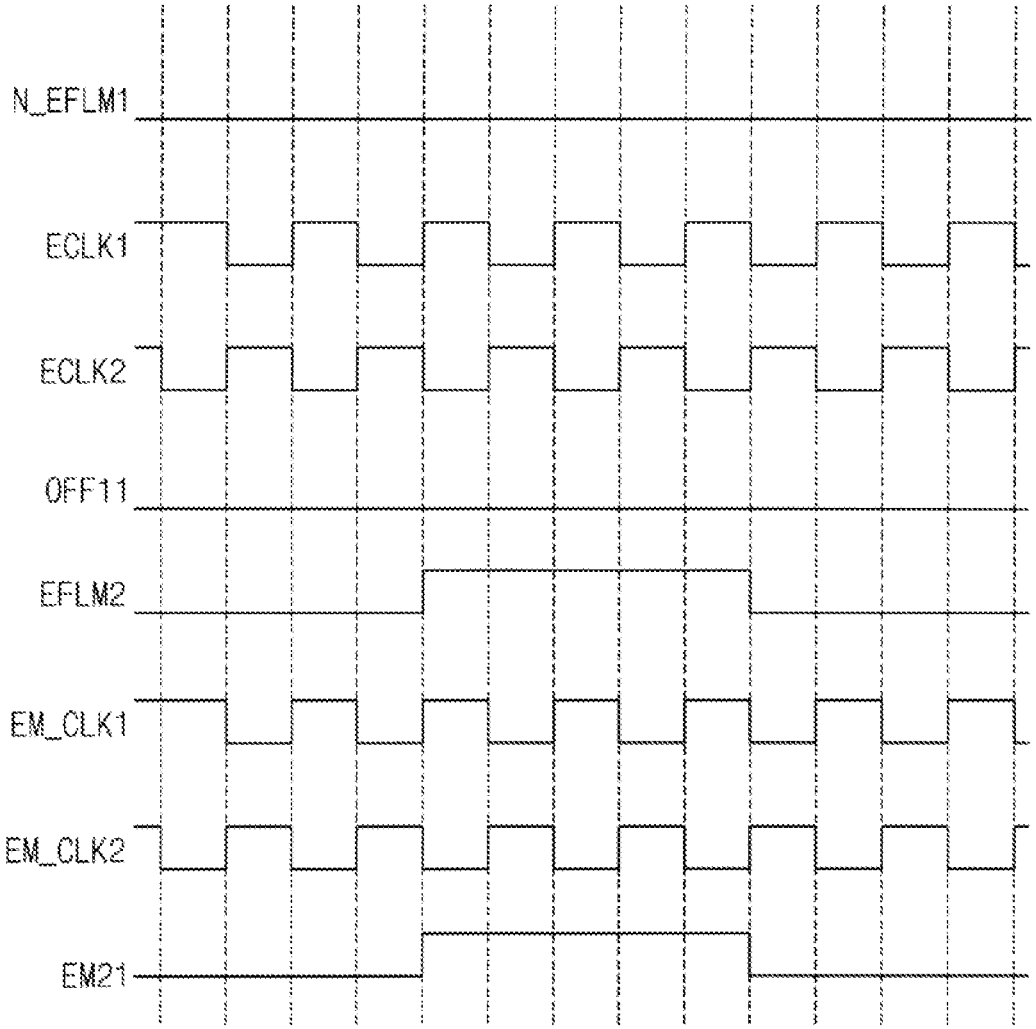
FIG. 10 illustrates an embodiment when the first emission driver does not operate and the second emission driver operates.

FIG. 10 is a timing diagram illustrating an embodiment of signals when the first emission driver 610 does not operate and the second emission driver 620 operates.

Referring to FIGS. 8 and 10, the timing controller 200 may provide the first emission non-start signal N_EFLM1 to the first emission driver 610 and the second emission start signal EFLM2 to the second emission driver 620. For example, when the first deterioration stress is greater than the second deterioration stress, the driver selector 213 may generate a signal for controlling the first emission driver 610 not to operate and the second emission driver 620 to operate. In this case, the timing controller 200 may provide the first emission non-start signal N_EFLM1 for not driving the first emission driver 610 to the first emission driver 610 and may provide the second emission start signal EFLM2 for driving the second emission driver 620 to the second emission driver 620. For example, the first stages ST11 to ST1($n$−1) and ST1($n$−1) to ST1N may output a first emission off signal OFF11 in response to the first emission non-start signal N_EFLM1. The second stages ST21 to ST2($n$−1) and ST2$n$ to ST2N may output a second emission signal EM21 synchronized with the first clock signal ECLK1 and the second clock signal ECLK2 in response to the second emission start signal EFLM2.

As described above, in accordance with one or more embodiments of the present inventive concept, the emission driver controller 210 may adjust the amount of use (e.g., usage time) of the first emission driver 610, such that the deterioration stress of the first emission driver 610 may be dispersed and the deterioration stress of the first to twelfth switching elements T1 to T12 in the first emission driver 610 may be reduced or minimized. As a result, the emission driver controller 210 may increase or maximize the lifetime of the second emission driver 610.

Figure 11:
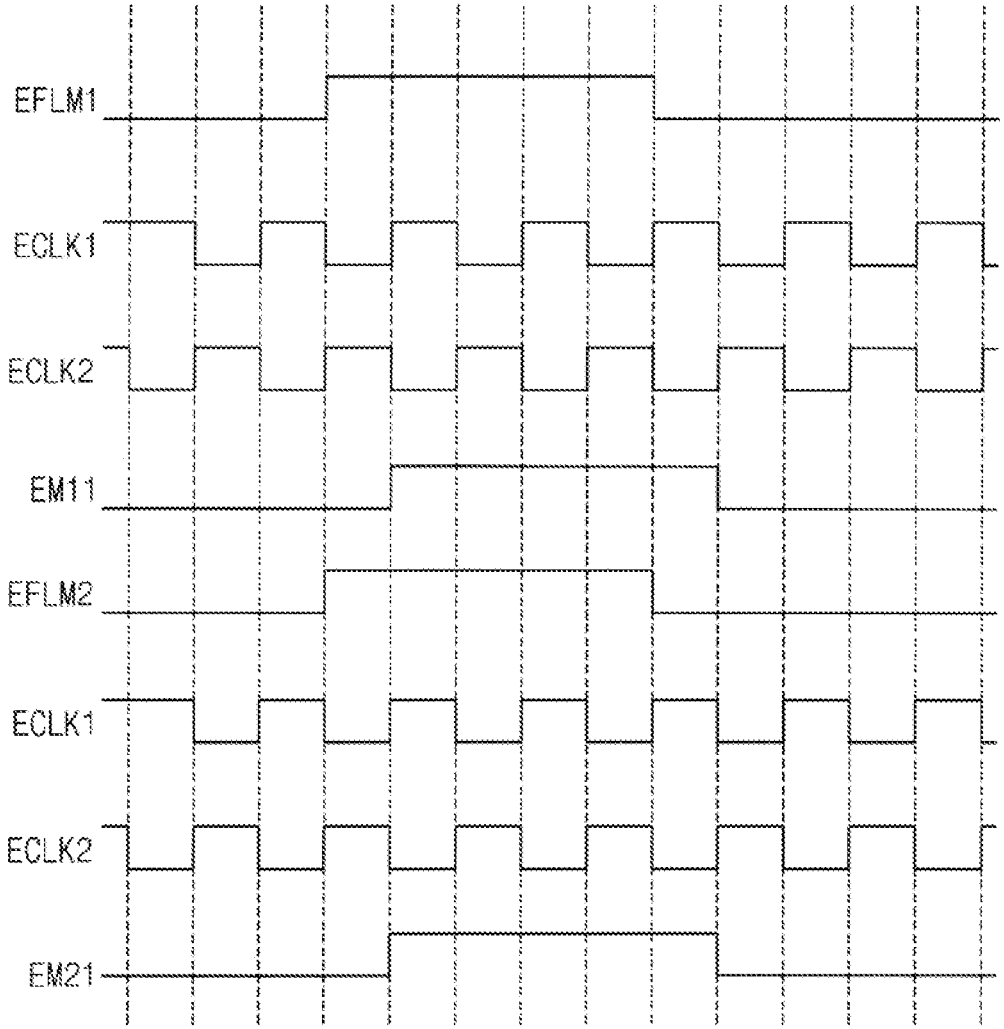
FIG. 11 illustrates an embodiment when the first and second emission drivers operate.

FIG. 11 is a timing diagram illustrating an embodiment of signals when both the first emission driver 610 and the second emission driver 620 operate.

Referring to FIGS. 8 and 11, the timing controller 200 may provide the first emission start signal EFLM1 to the first emission driver 610 and the second emission start signal EFLM2 to the second emission driver 620. For example, when both the first deterioration stress and the second deterioration stress are greater than the reference deterioration stress, the driver selector 213 may generate a signal for controlling both the first emission driver 610 and the second emission driver 620 to operate. In this case, the timing controller 200 may provide the first emission start signal EFLM1 for driving the first emission driver 610 to the first emission driver 610 and may provide the second emission start signal EFLM2 for driving the second emission driver 620 to the second emission driver 620. For example, the first stages ST11 to ST1($n$−1) and ST1($n$−1) to ST1N may output the first emission signal EM11 synchronized with the first clock signal ECLK1 and the second clock signal ECLK2 in response to the first emission start signal EFLM1. The second stages ST21 to ST2($n$−1) and ST2$n$ to ST2N may output the second emission signal EM21 synchronized with the first clock signal ECLK1 and the second clock signal ECLK2 in response to the second emission start signal EFLM2.

As described above, when both the first deterioration stress and second deterioration stress are greater than the reference deterioration stress, the emission driver controller 210 may operate both the first emission driver 610 and the second emission driver 620, so that the emission signal is output stably (or other predetermined manner) to the emission line EL.

Figure 12:
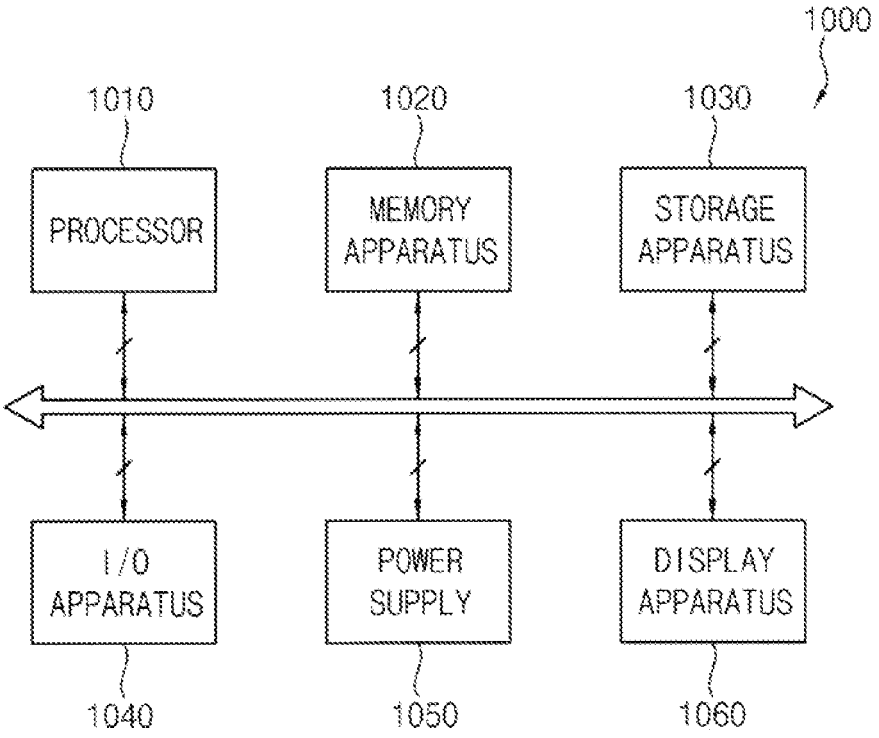
FIG. 12 illustrate embodiment of an electronic apparatus.
Figure 13:
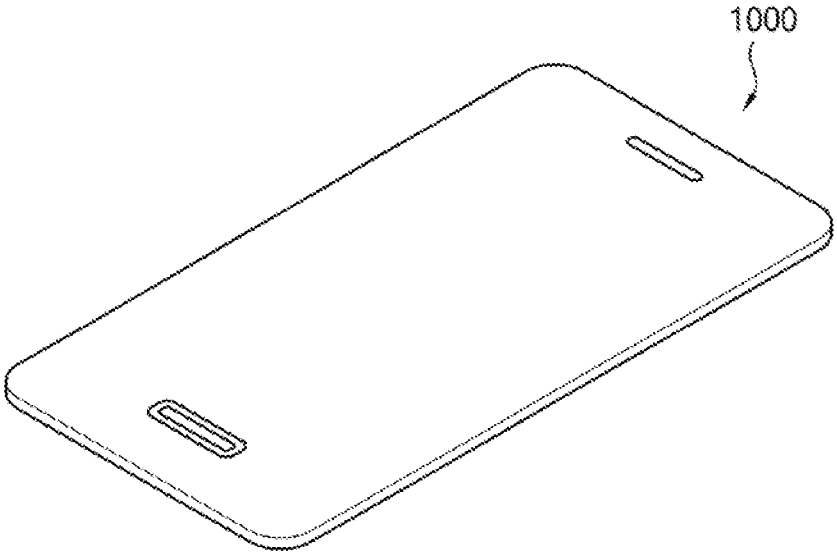
FIG. 13 illustrates an embodiment of an electronic apparatus.

FIG. 12 is a block diagram illustrating an embodiment of an electronic apparatus 1000 according to the present inventive concept, and FIG. 13 is a diagram illustrating an example in which the electronic apparatus 1000 of FIG. 12 is implemented as a smart phone.

Referring to FIGS. 12 and 13, the electronic apparatus 1000 may include a processor 1010, a memory apparatus 1020, a storage apparatus 1030, an input/output (I/O) apparatus 1040, a power supply 1050, and a display apparatus 1060. Here, the display apparatus 1060 may be the display apparatus 10 of FIG. 1.

In addition, the electronic apparatus 1000 may further include a plurality of ports for communicating with a video card, a sound card, a memory card, a universal serial bus (USB) apparatus, other electronic apparatus, and the like. In an embodiment, as illustrated in FIG. 13, the electronic apparatus 1000 may be implemented as a smart phone. However, the electronic apparatus 1000 may be implemented as a different device in another embodiment. Examples include a cellular phone, a video phone, a smart pad, a smart watch, a tablet PC, a car navigation system, a computer monitor, a laptop, a head mounted display (HMD) apparatus, and the like.

The processor 1010 may perform various computing functions. The processor 1010 may be a micro processor, a central processing unit (CPU), an application processor (AP), and the like. The processor 1010 may be coupled to other components via an address bus, a control bus, a data bus, and the like. Further, the processor 1010 may be coupled to an extended bus such as a peripheral component interconnection (PCI) bus. The memory apparatus 1020 may store data for operations of the electronic apparatus 1000. For example, the memory apparatus 1020 may include at least one non-volatile memory apparatus, such as an erasable programmable read-only memory (EPROM) apparatus, an electrically erasable programmable read-only memory (EEPROM) apparatus, a flash memory apparatus, a phase change random access memory (PRAM) apparatus, a resistance random access memory (RRAM) apparatus, a nano floating gate memory (NFGM) apparatus, a polymer random access memory (PoRAM) apparatus, a magnetic random access memory (MRAM) apparatus, a ferroelectric random access memory (FRAM) apparatus, and the like and/or at least one volatile memory apparatus such as a dynamic random access memory (DRAM) apparatus, a static random access memory (SRAM) apparatus, a mobile DRAM apparatus, and the like.

The storage apparatus 1030 may include a solid state drive (SSD) apparatus, a hard disk drive (HDD) apparatus, a CD-ROM apparatus, and the like. The I/O apparatus 1040 may include an input apparatus (e.g., a keyboard, a keypad, a mouse apparatus, a touch-pad, a touch-screen, and the like) and an output apparatus (e.g., a printer, a speaker, and the like). In some embodiments, the I/O apparatus 1040 may include the display apparatus 1060. The power supply 1050 may provide power for operations of the electronic apparatus 1000.

The display apparatus 1060 may display an image corresponding to visual information of the electronic apparatus 1000. The display apparatus 1060 may operate a plurality of emission drivers alternately (or a distributive or other predetermined manner) to increase or maximize the lifetimes of emission drivers.

In one embodiment, the display apparatus 1060 may include a display panel including a plurality of pixels, a first emission driver configured to apply an emission signal to the display panel and configured to be disposed on a first side, a second emission driver configured to apply the emission signal to the display panel and configured to be disposed on a second side opposite to the first side and an emission driver controller configured to selectively drive the first emission driver and the second emission driver according to deterioration stress of the first emission driver and the second emission driver. The emission driver controller may adjust the amount of use (or usage times) of the first emission driver and/or the second emission driver. The emission driver controller may reduce or minimize deterioration stress received by the first to twelfth switching elements in the first emission driver and the second emission driver.

As a result, the emission driver controller may increase or maximize the lifetimes of the first emission driver and/or the second emission driver through a distribution of one or both of the first deterioration stress or the second deterioration stress.

In accordance with one embodiment, a non-transitory computer-readable medium stores instructions, which, when executed by one or more processors, causes the one or more processors to perform the operations of the embodiments described herein. For example, in one embodiment, the one or more processors may execute the instructions to determine stress of a first emission driver (e.g., 610) of a display panel, determine stress of a second emission driver (e.g., 620) of the display panel, and control operation of at least one of the first emission driver or the second emission driver according to the stress of each of the first emission driver and the second emission driver.

The computer-readable medium may be included in, or coupled to, for example, the emission driver controller 210 or the timing controller 200. In one embodiment, the computer-readable medium may correspond to memory apparatus 1020, and may be, for example, any type of volatile or non-volatile memory. The one or more processors may correspond, for example, to the timing controller 200, emission driver controller 210, or processor 1010.

In operation, when the stress of the first emission driver is greater than the stress of the second emission driver, the one or more processors may execute the instructions to control activation of the second emission driver to reduce a difference between the stresses of the first emission driver and the second emission driver. In this way, deterioration stress may be distributed in more evenly between the first and second emission drivers or, otherwise, in a manner that achieves a predetermined distribution between the emission drivers.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments or operations of the apparatus embodiments herein.

The controllers, processors, devices, modules, units, multiplexers, calculators, converters, selectors, generators, logic, interfaces, decoders, drivers, generators and other signal generating and signal processing features of the embodiments disclosed herein may be implemented, for example, in non-transitory logic that may include hardware, software, or both. When implemented at least partially in hardware, the controllers, processors, calculators, converters, selectors, devices, modules, units, multiplexers, generators, logic, interfaces, decoders, drivers, generators and other signal generating and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, processors, devices, modules, units, multiplexers, generators, logic, interfaces, decoders, drivers, calculators, converters, selectors, generators and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings of the present inventive concept. Accordingly, such modifications are intended to be included within the scope of the present inventive concept as defined in the claims. The embodiments may be combined to form additional embodiments.

In the claims, means-plus-function clauses are not intended, but if interpreted to exist are meant to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A display apparatus, comprising:

a display panel including a plurality of pixels;

a first emission driver configured to apply an emission signal to the display panel and disposed on a first side of the display panel;

a second emission driver configured to apply the emission signal to the display panel and disposed on a second side of the display panel different from the first side; and an emission driver controller configured to selectively drive the first emission driver and the second emission driver according to deterioration stress of the first emission driver and the second emission driver, the deterioration stress to be determined by the emission driver controller based on active matrix organic light emitting diode off ratio data derived from luminance data.

2. The display apparatus of claim 1, wherein the emission driver controller comprises:

a data converter configured to convert the luminance data to the active matrix organic light emitting diode off ratio (AOR) data corresponding to the luminance data;

a stress calculator configured to calculate the deterioration stress of the first emission driver and the second emission driver based on the AOR data; and a driver selector configured to control operations of the first emission driver and the second emission driver according to the deterioration stress.

3. The display apparatus of claim 2, wherein the driver selector is configured to control the operations of the first emission driver and the second emission driver by comparing a first deterioration stress representing the deterioration stress of the first emission driver with a second deterioration stress representing the deterioration stress of the second emission driver.

4. The display apparatus of claim 3, wherein the data converter is configured to:

divide the luminance data into bands, and convert the luminance data to the AOR data corresponding to the bands.

5. The display apparatus of claim 4, wherein the data converter is configured to store a look up table including information indicative of the bands relative to the AOR data.

6. The display apparatus of claim 4, wherein the stress calculator is configured to calculate the deterioration stress by accumulating the AOR data according to driving times of the first emission driver and the second emission driver.

7. The display apparatus of claim 6, wherein:

when the first deterioration stress is less than the second deterioration stress, the driver selector is configured to control the first emission driver to operate and the second emission driver not to operate.

8. The display apparatus of claim 6, wherein:

when the first deterioration stress is greater than the second deterioration stress, the driver selector is configured to control the first emission driver not to operate and the second emission driver to operate.

9. The display apparatus of claim 6, wherein:

when the first deterioration stress and the second deterioration stress are greater than a reference deterioration stress, the driver selector is configured to control both the first emission driver and the second emission driver to operate.

10. The display apparatus of claim 2, wherein the emission driver controller is configured to accumulate the AOR data to store usage data and deterioration data of switching elements in the first emission driver and the second emission driver.

11. A method of operating a display apparatus, the method comprising:

calculating deterioration stress of a first emission driver and a second emission driver; and controlling the first emission driver and the second emission driver to selectively operate according to the deterioration stress, the deterioration stress calculated based on active matrix organic light emitting diode off ratio data derived from luminance data.

12. The method of claim 11, wherein calculating the deterioration stress comprises:

receiving the luminance data;

converting the luminance data to the active matrix organic light emitting diode off ratio (AOR) data corresponding to the luminance data; and calculating the deterioration stress of the first emission driver and the second emission driver based on the AOR data.

13. The method of claim 12, wherein controlling the first emission driver and the second emission driver comprises:

controlling operations of the first emission driver and the second emission driver by comparing a first deterioration stress representing the deterioration stress of the first emission driver with a second deterioration stress representing the deterioration stress of the second emission driver.

14. The method of claim 13, wherein calculating the deterioration stress comprises:

dividing the luminance data into bands; and converting the luminance data to the AOR data corresponding to the bands.

15. The method of claim 14, wherein calculating the deterioration stress comprises storing a look up table including information indicative of the bands relative to the AOR data.

16. The method of claim 14, wherein calculating the deterioration stress comprises calculating the deterioration stress by accumulating the AOR data according to driving times of the first emission driver and the second emission driver.

17. The method of claim 16, wherein controlling the first emission driver and the second emission driver comprises controlling the first emission driver to operate and the second emission driver not to operate when the first deterioration stress is less than the second deterioration stress.

18. The method of claim 16, wherein controlling the first emission driver and the second emission driver comprises controlling the first emission driver not to operate and the second emission driver to operate when the first deterioration stress is greater than the second deterioration stress.

19. The method of claim 16, wherein controlling the first emission driver and the second emission driver comprises controlling both the first emission driver and the second emission driver to operate when the first deterioration stress and the second deterioration stress are greater than a reference deterioration stress.

20. The method of claim 12, further comprising:

storing usage data and deterioration data of switching elements in the first emission driver and the second emission driver by accumulating the AOR data.

21. A non-transitory computer-readable medium configured to store instructions, which, when executed by one or more processors, causes the one or more processors to:

determine stress of a first emission driver of a display panel;

determine stress of a second emission driver of the display panel; and control operation of at least one of the first emission driver or the second emission driver according to the stress of each of the first emission driver and the second emission driver, wherein the stress of the first emission driver and the stress of the second emission driver are determined based on active matrix organic light emitting diode off ratio data derived from luminance data and wherein, when the stress of the first emission driver is greater than the stress of the second emission driver, the one or more processors are configured to execute the instructions to control activation of the second emission driver to reduce a difference between the stresses of the first emission driver and the second emission driver.

* * * * *